US005856011A

United States Patent [19]

Sogabe

[11] Patent Number: 5,856,011

[45] Date of Patent: Jan. 5, 1999

[54] THERMAL TRANSFER RECORDING MEDIUM

[75] Inventor: Jun Sogabe, Osaka, Japan

[73] Assignee: Fujicopian Co., Ltd., Osaka, Japan

[21] Appl. No.: 949,940

[22] Filed: Oct. 14, 1997

[30] Foreign Application Priority Data

Oct. 14, 1996 [JP] Japan ..... 8-271129

[51] Int. Cl.[6] ..... B41M 5/26

[52] U.S. Cl. ..... 428/411.1; 428/195; 428/447; 428/484; 428/488.1; 428/488.4

[58] Field of Search ..... 428/195, 488.4, 428/484, 488.1, 411.1, 447

[56] References Cited

FOREIGN PATENT DOCUMENTS 61-290093 12/1986 Japan .

*Primary Examiner*—Pamela R. Schwartz
*Attorney, Agent, or Firm*—Fish & Neave

[57] ABSTRACT

A thermal transfer recording medium comprising a foundation, a heat-meltable ink layer comprising a coloring agent and a heat-meltable vehicle disposed on one side of the foundation, and a back layer comprising a heat-resistant resin disposed on the other side of the foundation, the ink layer containing a surface active agent, the back layer containing a surface active agent, the ink layer and the back layer satisfying the following relations:

$$A \geqq 3,\ B \geqq 3,\ C \geqq 0,\ A > C,\ B > C,$$

wherein A is the absolute value of the difference between the SP value of the heat-meltable vehicle of the ink layer and the SP value of the surface active agent contained in the ink layer; B is the absolute value of the difference between the SP value of the heat-resistant resin of the back layer and the SP value of the surface active agent contained in the back layer; and C is the absolute value of the difference between the SP value of the surface active agent contained in the ink layer and the SP value of the surface active agent contained in the back layer.

4 Claims, No Drawings

THERMAL TRANSFER RECORDING MEDIUM

BACKGROUND OF THE INVENTION

The present invention relates to a thermal transfer recording medium comprising a foundation having a heat-meltable ink layer on one side thereof and a back layer on the other side thereof.

A conventional thermal transfer recording medium of this type is adapted to form printed images by superimposing a receptor on the side of the heat-meltable ink layer and heating the recording medium from the back side thereof by means of a thermal head to transfer the heat-meltable ink onto the receptor.

The main purpose of providing the back layer is to prevent the so-called sticking phenomenon wherein the foundation melts and sticks to the thermal head.

Such a back layer is composed of a heat-resistant resin as a main ingredient. For instance, a back layer is known which is formed by applying onto a foundation a silicone-modified resin such as a silicone-modified acrylic resin, followed by curing.

When a thermal transfer recording medium having the back layer made of the silicone-modified resin is employed to form printed images, there is a disadvantage that the heat-meltable ink at the heated portion is not completely transferred onto a receptor, resulting in printed images having dropout portions or voids.

The present inventor's investigation of the causes reveals the following: With a thermal transfer recording medium which is wound in the form of a roll, the heat-meltable ink layer and the back layer are in contact with each other. In such a state, a low molecular weight component contained in the silicone-modified resin constituting the back layer migrates to the heat-meltable ink layer. The portion of the ink layer to which the low molecular weight component has migrated does not transfer to a receptor because of poor adhesion to the receptor. In addition to such a transfer disturbance, there is a further problem that the migration of a component of the ink layer to the back layer invites a decrease in the slipping property of the back layer, resulting in a disturbance of the travelling of the thermal transfer recording medium.

In view of the foregoing, an object of the present invention is to provide a thermal transfer recording medium which is free from the transfer disturbance and travelling disturbance due to the migration of a component of the back layer thereof to the ink layer thereof the and migration of a component of the ink layer to the back layer.

This and other objects of the present invention will become apparent from the description hereinafter.

SUMMARY OF THE INVENTION

The present invention provides a thermal transfer recording medium comprising a foundation, a heat-meltable ink layer comprising a coloring agent and a heat-meltable vehicle disposed on one side of the foundation, and a back layer comprising a heat-resistant resin disposed on the other side of the foundation, the ink layer containing a surface active agent, the back layer containing a surface active agent, the ink layer and the back layer satisfying the following relations:

$$A \geqq 3$$

$$B \leqq 3$$

$$C \geqq 0$$

$$A > C$$

$$B > C$$

wherein

A is the absolute value of the difference between the solubility parameter of the heat-meltable vehicle of the ink layer and the solubility parameter of the surface active agent contained in the ink layer;

B is the absolute value of the difference between the solubility parameter of the heat-resistant resin of the back layer and the solubility parameter of the surface active agent contained in the back layer; and C is the absolute value of the difference between the solubility parameter of the surface active agent contained in the ink layer and the solubility parameter of the layer active agent contained in the back surface.

In an embodiment of the present invention, the surface active agent contained in the ink layer is the same as the surface active agent contained in the back layer.

In another embodiment of the present invention, the content of the surface active agent in the ink-layer is from 0.1 to 10% by weight and the content of the surface active agent in the back layer is from 0.1 to 10% by weight.

In a further embodiment of the present invention, the heat-resistant resin of the back layer comprises a silicone-modified resin.

DETAILED DESCRIPTION

In the thermal transfer recording medium of the present invention which comprises a foundation, a heat-meltable ink layer comprising a coloring agent and a heat-meltable vehicle disposed on one side of the foundation, and a back layer comprising a heat-resistant resin disposed on the other side of the foundation and wherein the ink layer contains a surface active agent and the back layer contains a surface active agent, the absolute value, A, of the difference between the solubility parameter (hereinafter referred to as "SP value") of the surface active agent contained in the ink layer and the SP value of the heat-meltable vehicle of the ink layer (hereinafter, sometimes the absolute value A is referred to as "SP difference A") satisfies the following equation:

$$A \geqq 3, \text{ and}$$

the absolute value, B, of the difference between the SP value of the surface active agent contained in the back layer and the SP value of the heat-resistant resin of the back layer (hereinafter, sometimes the absolute value B is referred to as "SP difference B") satisfies the following equation:

$$B \geqq 3.$$

The surface active agent contained in the ink layer and the surface active agent contained in the back layer migrate or bleed to the surface of the ink layer and the surface of the back layer, respectively, because the respective surface active agents are greatly incompatible with the main ingredient of the ink layer and the main ingredient of the back layer, as defined above.

When such a thermal transfer recording medium, after being wound in the form of a roll, is stored, the ink layer and the back layer are in contact with each other. According to the present invention, in such a state, there exist the following relations between the SP difference A or the SP difference B and the absolute value, C, of the difference between the SP value of the surface active agent contained in the ink layer and the SP value of the surface active agent contained in the back layer (hereinafter, sometimes the absolute value C is referred to as "SP difference C"):

$$A>C$$

$$B>C.$$

Thus, the following effects are exerted due to such relations: By virtue of the relation: B>C, the surface active agent which is contained in the back layer and migrates or bleeds to the surface of the back layer is likely to migrate toward the ink layer, while by virtue of the relation: A>C, the surface active agent which is contained in the ink layer and migrates or bleeds to the surface of the ink layer is likely to migrate toward the back layer. As a result, a component of the ink layer and a component of the back layer are prevented from migrating to the back layer and migrating to the ink layer, respectively, by a barrier comprising the surface active agents formed in the interface between both layers.

When the SP difference A and the SP difference B are respectively:

$$A<3$$

$$B<3,$$

the surface active agent contained in the ink layer and the surface active agent contained in the back layer do not sufficiently migrate or bleed to the surface of the ink layer and the surface of the back layer, respectively.

When the relations between the SP difference A, B and the SP difference C are:

$$A\leqq C$$

$$B\leqq C,$$

a component of the ink layer and a component of the back layer are not sufficiently prevented from migrating to the back layer and from migrating to the ink layer, respectively.

The surface active agent contained in the ink layer may be the same as or different from the surface active agent contained in the back layer. Thus, the SP difference C is:

$$C\geqq 0.$$

In the case that the surface active agent used in the ink layer or the back layer is a mixture of two or ore surface active agents having different SP values, an average value, $SP_{av}$, as defined below is used as the SP value for the mixture.

That is, when a mixture comprises surface active agents each having an SP value of $SP_i$ (i=1 to n) and the weight ratio of the surface active agent having an SP value of $SP_i$ to the total amount of the surface active agents is $W_i$, the $SP_{av}$ for the mixture is defined by the following formula:

$$SP_{av} = \sum_{i}^{n} SP_i \times W_i$$

If the vehicle of the ink layer comprises two or more components or if the heat-resistant resin of the back layer comprises two or more components, $SP_{av}$ values obtained in the same manner as above are used for the respective mixtures.

When employing two or more components in combination as the surface active agent, vehicle or heat-resistant resin for the ink layer or the back layer, it is preferable that materials used in combination are substantially compatible or miscible with each other and, hence, the difference in SP value between the materials used in combination falls within the range of ±3.

The upper limit of the SP difference A, B or C is not particularly limited. However, when the SP difference A, B or C is too large, the fixability of the surface active agents in the interface between the ink layer and the back layer becomes poor. Therefore, the preferred SP difference A, B and C are as follows:

$$A\leqq 12$$

$$B\leqq 12$$

$$C\leqq 8.$$

The surface active agents to be contained in the ink layer or back layer are preferably solid or semi-solid nonionic surface active agents selected from polyethylene glycol fatty acid esters, polyglycerol fatty acid esters, polyoxyethylene glycerol fatty acid esters, polyoxythylene sorbitan fatty acid esters, polyethylene glycol fatty acid amides, and the like. Liquid surface active agents are undesirable because they cause greasiness or tackiness when they bleed to the surface of the ink layer or back layer. Those surface active agents can be used either alone or in combination of two or more species thereof. The surface active agents used in the ink layer and the back layer may be the same or different from each other. However, it is preferable to use the same surface active agent both in the ink layer and the back layer because favorable orientation between the surface active agent bled to the surface of the ink layer and the surface active agent bled to the surface of the back layer is attained.

When the content of the surface active agent in the ink layer or back layer is too small, it is difficult to sufficiently prevent a component of the ink layer or a component of the back layer from migrating to the respective opposite surfaces. When the content is too large, the slipping property of the back layer is prone to decrease. From this viewpoint, the content of the surface active agent in the back layer is preferably from 0.1 to 10% by weight, more preferably from 0.5 to 5% by weight and the content of the surface active agent in the ink layer is preferably from 0.1 to 10% by weight, more preferably from 0.5 to 5% by weight.

In particular, the present invention is effectively applicable wherein a silicone-modified resin containing a low molecular weight component having a releasing property, or the like is used as the heat-resistant resin for the back layer. Examples of such a silicone-modified resin are polyester resins, (meth)acrylic acid ester resins, styrene-acrylate resins, polyurethane resins, poly(vinyl butyral) resins, polyamide resins, and the like, each of which is modified with a silicone.

The present invention is also effectively applicable wherein other heat-resistant resins such as (meth)acrylate resin, styrene-acrylate resin, polyurethane resin, poly(vinyl butyral) resin, or the like are used for the back layer.

The back layer can be incorporated with a curing agent, an antistatic agent, a levelling agent, or the like in addition to the aforesaid ingredients, so long as the object of the present invention is not injured.

The back layer can be formed by applying onto a foundation a coating liquid prepared by dissolving or dispersing the aforesaid resin component, surface active agent, and, as required, the curing agent and other additives in an appropriate solvent, followed by drying.

The coating amount (coating amount after drying, hereinafter the same) of the back layer is preferably from 0.01 to 1.0 g/m$^2$. When the coating amount is smaller than the above range, sufficient sticking-preventive effect is not obtained. When the coating amount is larger than the above range, heat conduction to the ink layer is disturbed.

The heat-meltable ink layer in accordance with the present invention comprises a coloring agent, a heat-meltable vehicle and a surface active agent. Preferably the heat-meltable vehicle comprises a thermoplastic resin and/or a wax.

Examples of specific waxes include: natural waxes such as haze wax, bees wax, lanolin, carnauba wax, candelilla wax, montan wax and ceresine wax; petroleum waxes such as paraffin wax and microcrystalline wax; synthetic waxes such as oxidized waxes, ester waxes, polyethylene wax, Fischer-Tropsch wax and α-olefin-maleic anhydride copolymer wax; higher fatty acids such as lauric acid, myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as oleic acid amide. These waxes can be used either alone or in combination of two or more species thereof.

Examples of specific thermoplastic resins (inclusive of elastomers) include olefinic copolymers such as ethylene-vinyl acetate copolymer and ethylene-acrylic ester copolymers, polyamide resins, polyester resins, epoxy resins, polyurethane resins, acrylic resins, vinyl chloride resins, cellulose resins, vinyl alcohol resins, petroleum resins, phenol resins, styrene resins, vinyl acetate resins, natural rubber, styrene-butadiene rubber, isoprene rubber, chloroprene rubber, polyisobutylene and polybutene. These resins can be used either alone or in combination of two or more species thereof.

Usful as the coloring agent are carbon black as well as various organic and inorganic pigments and dyes.

The ink layer can be incorporated with a dispersing agent, an antistatic agent, a levelling agent, or the like in addition to the aforesaid ingredients, so long as the object of the present invention is not injured.

The ink layer can be formed by applying on the foundation a coating liquid prepared by dissolving or dispersing the aforesaid vehicle ingredient, coloring agent, surface active agent and, as required, the curing agent and other additive in an appropriate solvent (inclusive of aqueous solvent), followed by drying. Alternatively the ink layer can be formed by a hot-melt coating method.

The coating amount of the ink layer is preferably from 0.3 to 5.0 g/m$^2$.

Usful as the foundation in the present invention are those commonly used for the foundation of thermal transfer recording media of this type with no particular limitation. Examples of foundations are, for instance, plastic films such as polyester films including poly(ethylene terephthalate) film, poly(ethylene naphthalate) film and polyarylate film, polycarbonate film, polyamide film, aramid film, polyamideimide film, polyimide film and cellophane; and high density paper sheets such as glassine paper and condenser paper. The thickness of the foundation is preferably from 1.5 to 10 μm.

As required, a release layer may be provided between the foundation and the heat-meltable ink layer.

Various embodiments can be adopted for the arrangement of the heat-meltable ink layer on the foundation, inclusive of an embodiment wherein an ink layer of single color is provided on a foundation, and another embodiment wherein ink layers of two or more different colors (e.g. yellow ink layer, magenta ink layer and cyan ink layer, and, as required, black ink layer) are provided on a foundation in a side-by-side relation.

The present invention will be more fully described by way of Examples and Comparative Examples. It is to be understood that the present invention is not limited to these Examples, and various changes and modifications may be made in the invention without departing from the spirit and scope thereof.

Examples 1 to 2 and Comparative Examples 1 to 3

Onto one side of a 3.5 μm-thick poly(ethylene terephthalate) film was applied a coating liquid of the below-mentioned formulation 1*a* or 1*b* for a back layer, followed by drying to form a back layer in a coating amount of 0.3 g/m$^2$.

| Component | Part by weight |
|---|---|
| Back layer coating liquid formulation 1a | |
| Silicone-modified acrylic resin (SP value: 8.0) | 10 |
| Surface active agent (refer to Table 1) | 0.5 |
| Methyl ethyl ketone | 90 |
| Back layer coating liquid formulation 1b | |
| Polyurethane resin (SP value: 10.0) | 10 |
| Surface active agent (refer to Table 1) | 0.5 |
| Methyl ethyl ketone | 40 |

Onto the opposite side of the poly(ethylene terephthalate) film with respect to the back layer was applied a mixed wax of the below-mentioned formulation by a hot-melt coating method to form a release layer in a coating amount of 1.0 g/m$^2$.

| Component | Part by weight |
|---|---|
| Paraffin wax | 60 |
| Candelilla wax | 40 |

Onto the release layer was applied a coating liquid of the below-mentioned formulation 2*a* or 2*b* for the heat-meltable ink layer, followed by drying to form a heat-meltable ink layer in a coating amount of 1.0 g/m$^2$. Thus, a thermal transfer recording medium was obtained.

| Component | Part by weight |
|---|---|
| Ink layer coating liquid formulation 2a | |
| Ethylene-vinyl acetate copolymer (SP value: 8.5) | 8 |
| Phthalocyanine Blue | 2 |
| Dispersing agent | 0.2 |
| Surface active agent (refer to Table 1) | 0.5 |
| Toluene | 40 |
| Ink layer coating liquid formulation 2b | |
| Polyamide resin (SP value: 13.0) | 8 |
| Phthalocyanine Blue | 2 |
| Dispersing agent | 0.2 |
| Surface active agent (refer to Table 1) | 0.5 |
| Toluene | 10 |
| Isopropyl alcohol | 30 |

Each of the thus obtained thermal transfer recording media was slit into strips each having a width of 12.7 mm while being wound on cores. Thus ink ribbons wound in the form of a roll were obtained.

The ink ribbon in the form of a roll was allowed to stand at 50° C. and 85% RH for 48 hours, and then loaded in a thermal transfer printer (Bungo JX 5500 made by NEC Corporation). Printing was conducted to form a printed image of a checkered pattern of 10% duty on a receptor paper (thermal transfer paper). The transferability and travelling property of the ink ribbon were evaluated in the following ways. The results are shown in Table 1.

Transferability

The ratio of the area of the actually transferred ink to the area of the ink to be ideally transferred (hereinafter referred to as transfer ratio) was determined as to the obtained image, and the transferability was evaluated according to the following criterion:

○—transfer ratio: not less than 95%

Δ—transfer ratio: not less than 90% and less than 95%

×—transfer ratio: not less than 90%

Travelling property

A continuous running test was conducted over the entire length (130 m) of the ink ribbon of one roll under the same printing conditions as above and the travelling property of the ink ribbon was evaluated according to the following criterion:

○—Stable travelling is possible over the entire length of the ink ribbon of one roll ×—Travelling becomes unstable halfway

TABLE 1

| | Heat-meltable ink layer | | Back layer | | SP difference | | | Evaluation | |
|---|---|---|---|---|---|---|---|---|---|
| | Formulation | Surface active agent* | Formulation | Surface active agent* | A | B | C | Transferability | Travelling |
| Ex.1 | 2a | Polyethylene glycol (400) oleic acid monoester [12.5] | 1a | Polyethylene glycol (400) oleic acid monoester [12.5] | 4.0 | 4.5 | 0 | ○ | ○ |
| Ex.2 | 2a | Polyethylene glycol (1540) lauric acid monoester [13.2] | 1a | Polyethylene glycol (400) oleic acid monoester [12.5] | 4.7 | 4.5 | 0.7 | ○ | ○ |
| Com. Ex.1 | 2b | Polyethylene glycol (1540) lauric acid monoester [13.2] | 1a | Polyethylene glycol (400) oleic acid monoester [12.5] | 0.2 | 4.5 | 0.7 | Δ | ○ |
| Com. Ex.2 | 2a | Polyethylene glycol (1540) lauric acid monoester [13.2] | 1b | Polyethylene glycol (400) oleic acid monoester [12.5] | 4.7 | 2.5 | 0.7 | ○ | X |
| Com. Ex.3 | 2a | — | 1b | — | — | — | — | X | X |

*The value in parentheses [ ] indicates SP value.
The value in parentheses ( ) indicates the molecular weight of polyethylene glycol component.

In the thermal transfer recording medium of the present invention the transfer disturbance and travelling disturbance is prevented due to the migration of a component of the back layer and a component of the in layer to the respective opposite layers, thereby providing clear printed images without dropout portions or voids.

In addition to the materials and ingredients used in the Examples other materials and ingredients can be used in the present invention as set forth in the specification to obtain substantially the same results.

What is claimed is:

1. A thermal transfer recording medium comprising a foundation, a heat-meltable ink layer comprising a coloring agent and a heat-meltable vehicle disposed on one side of the foundation, and a back layer comprising a heat-resistant resin disposed on the other side of the foundation, the ink layer containing a surface active agent, the back layer containing a surface active agent, the ink layer and the back layer satisfying the following relations:

$$A \geqq 3$$

$$B \geqq 3$$

$$C \geqq 0$$

$$A > C$$

$$B > C$$

wherein

A is the absolute value of the difference between the solubility parameter of the heat-meltable vehicle of the ink layer and the solubility parameter of the surface active agent contained in the ink layer;

B is the absolute value of the difference between the solubility parameter of the heat-resistant resin of the back layer and the solubility parameter of the surface active agent contained in the back layer; and C is the absolute value of the difference between the solubility parameter of the surface active agent contained in the ink layer and the solubility parameter of the surface active agent contained in the back layer.

2. The thermal transfer recording medium of claim 1, wherein the surface active agent contained in the ink layer is the same as the surface active agent contained in the back layer.

3. The thermal transfer recording medium of claim 1, wherein the content of the surface active agent in the ink layer is from 0.1 to 10% by weight and the content of the surface active agent in the back layer is from 0.1 to 10% by weight.

4. The thermal transfer recording medium of claim 1, wherein the heat-resistant resin of the back layer comprises a silicone-modified resin.

* * * * *

UNITED STATES PATENT AND TRADEMARK OFFICE

CERTIFICATE OF CORRECTION

PATENT NO. : 5,856,011

DATED : January 5, 1999

INVENTOR(S) : Sogabe

It is certified that error appears in the above-identified patent and that said Letters Patent is hereby corrected as shown below:

Column 1, line 49 delete "the and" and substitute therefor -- and the --.

Column 1, line 67 delete "B ≤ 3" and substitute therefor -- B ≥ 3 --.

Column 2, line 17 delete "layer active" and substitute therefor -- surface active --.

Column 2, line 18 delete "surface." and substitute therefor -- layer. --.

Column 3, line 47 delete "ore" and substitute therefor -- more --.

Column 5, line 32 delete "Usful" and substitute therefor -- Useful --.

Column 5, line 47 delete "Usful" and substitute therefor -- Useful --.

Column 7, line 55 delete "in" and substitute therefor -- ink --.

Signed and Sealed this

Twenty-third Day of January, 2001

*Attest:*

*Attesting Officer*

Q. TODD DICKINSON

*Commissioner of Patents and Trademarks*